US006874627B2

(12) United States Patent
Maeng

(10) Patent No.: US 6,874,627 B2
(45) Date of Patent: Apr. 5, 2005

(54) PROTECTIVE COVER FOR A GOLF CLUB

(76) Inventor: Seop Maeng, 104-601 Jeongdeun village, 200 Jeongja-dong, Bundang-gu, Seongnam-city, Gyeonggi-do (KR)

( * ) Notice: Subject to any disclaimer, the term of this patent is extended or adjusted under 35 U.S.C. 154(b) by 0 days.

(21) Appl. No.: 10/280,230

(22) Filed: Oct. 25, 2002

(65) Prior Publication Data

US 2004/0079458 A1 Apr. 29, 2004

(51) Int. Cl.[7] ..... A63B 57/00

(52) U.S. Cl. ..... 206/315.2; 206/315.4; 150/160

(58) Field of Search ..... 150/159, 160; 206/315.2, 315.4

(56) References Cited

U.S. PATENT DOCUMENTS 2,128,546 A * 8/1938 Venmore ..... 211/70.2
2,508,525 A * 5/1950 Le Fevre ..... 150/160
2,705,039 A * 3/1955 Halter ..... 150/160
3,117,609 A * 1/1964 Pio ..... 150/160
3,613,760 A * 10/1971 Koehnle ..... 150/160
3,664,399 A * 5/1972 Neff ..... 150/160
3,892,267 A * 7/1975 Bibeau ..... 150/160
4,378,832 A * 4/1983 Thompson ..... 150/160
5,000,238 A * 3/1991 Zeller ..... 150/160
5,002,185 A * 3/1991 Schurman ..... 206/315.4
5,050,655 A * 9/1991 Borenstein ..... 150/160
5,284,194 A * 2/1994 Gaffney ..... 150/160
5,819,829 A * 10/1998 Matthews ..... 150/159
6,044,880 A * 4/2000 Maeng ..... 150/160
6,119,742 A * 9/2000 Maeng ..... 150/160
6,192,950 B1 * 2/2001 Maeng ..... 150/160
6,202,723 B1 * 3/2001 Maeng ..... 150/160

FOREIGN PATENT DOCUMENTS

GB 2115294 A * 9/1983 ..... A63B/57/00

* cited by examiner

*Primary Examiner*—Sue A. Weaver
(74) *Attorney, Agent, or Firm*—Chapman and Cutler LLP

(57) ABSTRACT

A protective cover for a golf club includes a cover body and an internal frame and may include an elastic means for biasing the cover to an open condition. The cover body is made of cushioning fabric material and includes a head portion for covering and protecting the head of the golf club and a shank portion extending downwardly from the head portion for enclosing an upper part of the shaft of the golf club. The frame is principally covered by the cover body and comprises a hinge, wings that swing about the hinge to open and close the protective cover, and fastening means at free edges of the wings. The elastic means if present is attached to the outer surface of the frame and resiliently biases the wings of the frame to the open position. Part of the cover at the head is unsupported by the interior frame, to accommodate club heads of various sizes and shapes. The cover can be opened and closed with just one hand of the user.

12 Claims, 6 Drawing Sheets

FIG. 9
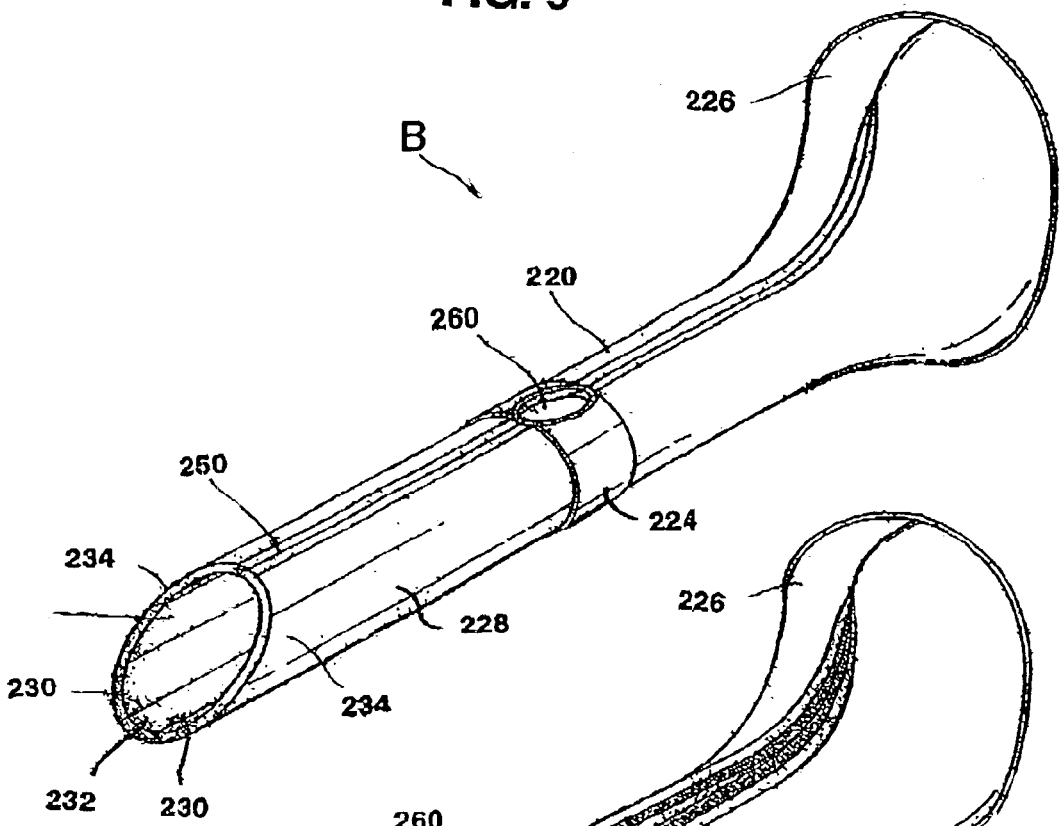
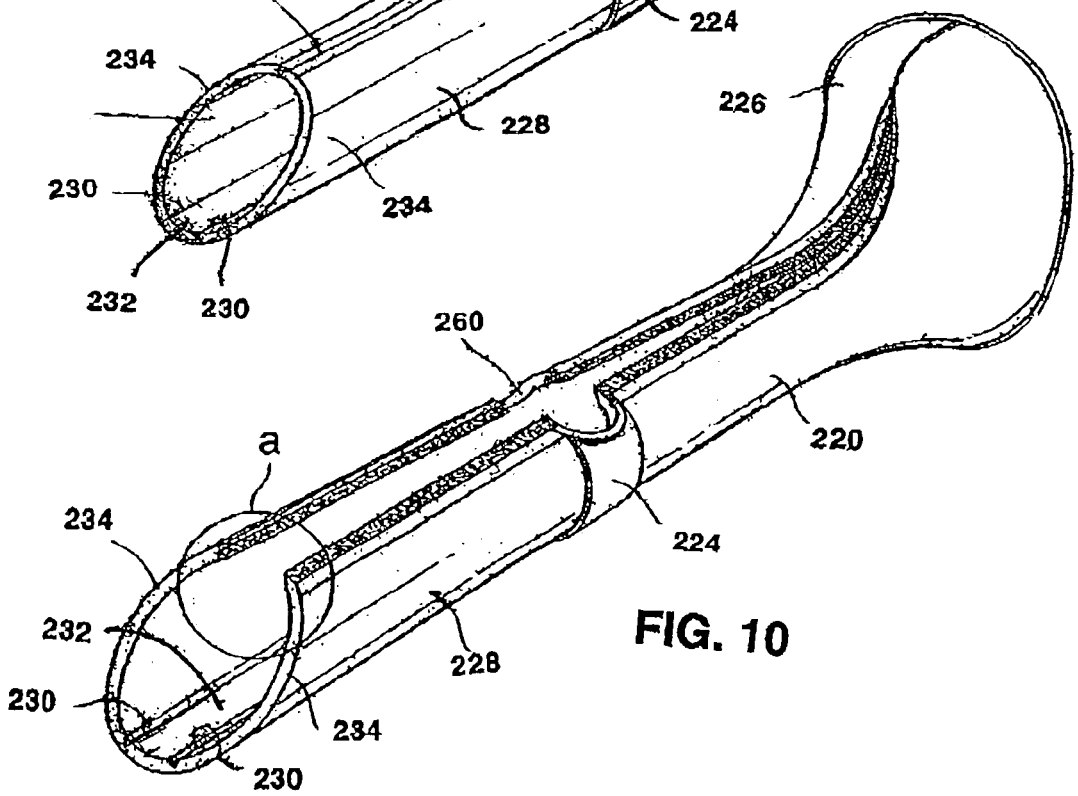
FIG. 10

FIG. 11
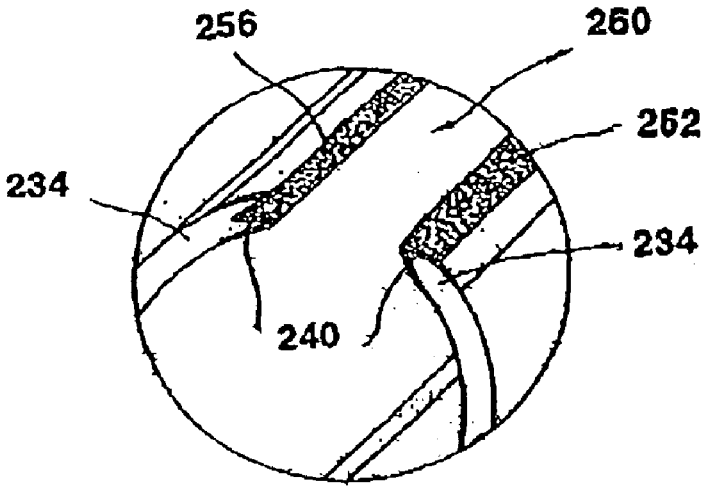
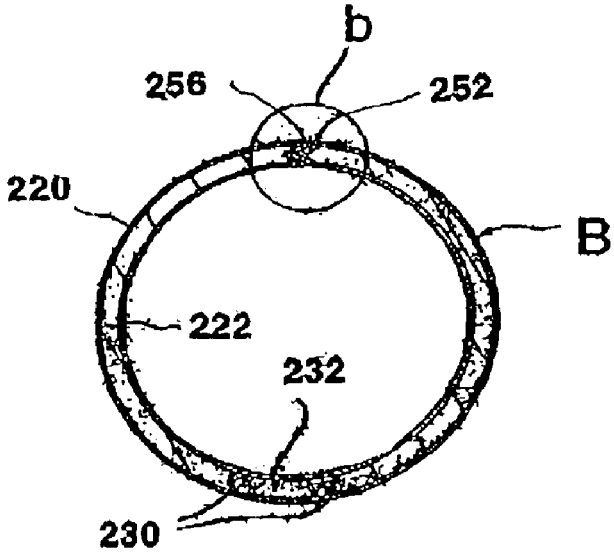
FIG. 12
FIG. 13
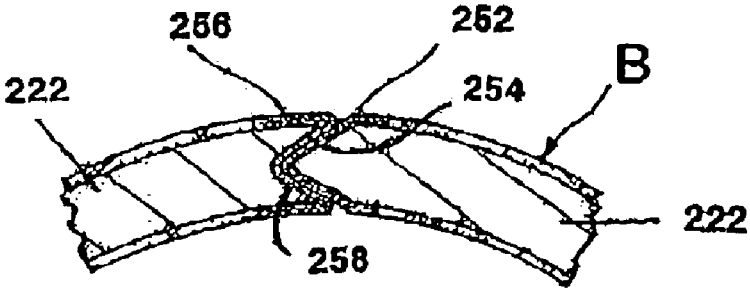

PROTECTIVE COVER FOR A GOLF CLUB

BACKGROUND OF THE INVENTION

1. Field of the Invention

The present invention relates to covers for golf club heads, particularly to protective covers made for single-handed operation, and which have simple construction, are convenient to use, and easy to fabricate.

2. The Prior Art

Several types of protective covers for golf clubs are in use or proposed. Typically, the protective cover is made of fabric and put on over the head of the golf club, as in FIG. 14 hereof. The conventional protective cover A is pouch-shaped to cover both a head and an upper portion of a shaft of a golf club. The conventional protective cover A is longitudinally slit to allow easy insertion of the head and shaft of the golf club. A slide fastener Z is attached to the slit portion of the cover A and is opened before placing the cover A onto the golf club, then closed to protect the head and the upper portion of the shaft. Protective cover A is inconvenient to use because the slide fastener Z must be manipulated using both hands whenever the cover A is put onto or taken off from the golf club.

U.S. Pat. No. 6,202,723, by the present inventor, as shown in FIG. 15, discloses a protective cover for a golf club that is selectively opened and closed by being bent along its length. This protective cover cannot be easily opened because the protective cover uses the cover's own resilience to assist its opening. Where the protective cover is layered with a fabric, the cover is thicker and more difficult to bend and fold. Thus, it can be difficult to open and shut the protective cover with a single hand. Also, a hinge formed on a central portion of the cover body forms a hump when the protective cover is opened for inserting the golf club into the cover, which can make it less convenient to insert the golf club.

FIG. 16 illustrates a further known protective cover for a golf club, as disclosed in U.S. Pat. No. 6,119,742. This cover includes a pair of cover bodies and a hinge between and connecting them. This hinge too forms a hump when the protective cover is opened for inserting the golf club, reducing the ease of use by encouraging the golf club to shift to one side when placed into the open cover. Further, this cover comprises a top wall F1, a side wall F2, and a bottom wall F3, are all formed through an injection molding process, which requires different injection molds for accommodating various models and sizes of heads of golf clubs in any typical set.

SUMMARY OF THE INVENTION

An object of the present invention is to provide a protective cover for a golf club which is easily opened and shut merely by grasping the protective cover with a single hand, and which has simple construction, thereby being convenient to use and facilitating its fabrication.

Another object of the present invention is to provide a protective cover for a golf club, a lower portion of the cover being formed by injection molding, thereby reducing its weight and being useable with the head of any golf club.

A further object of this invention is to provide a golf club cover having a simple opening and closing structure, thus reducing its manufacturing cost.

In order to accomplish the above objects, the present invention provides a protective cover comprising a fabric body with a head portion for covering and protecting the head of the golf club and a shank portion extending downwardly therefrom for enclosing a shaft of the golf club. An internal frame gives shape to the cover in its shank and in a lower part of the head. A hinge extends longitudinally of the frame, forming pair of wings along opposite sides of the hinge line for opening and closing the cover. Fastening means are attached to both of the free side edges of the wings, so they can be detachably interlocked with each other to keep the cover closed about the golf club. An elastic device may optionally be attached to an outer surface of the frame and the wings for biasing the frame into the open position.

BRIEF DESCRIPTION OF THE DRAWINGS

FIG. 9 is a perspective view of a third form of protective cover for golf clubs, with the cover fully closed;

FIG. 10 is a perspective view of the protective cover of FIG. 9, slightly opened;

FIG. 11 is an enlarged perspective view of the portion "a" encircled in FIG. 10;

FIG. 12 is a vertical sectional view of a shank portion of the protective cover of FIG. 9;

FIG. 13 is an enlarged plan view of the part "b" encircled in FIG. 12;

DESCRIPTION OF THE PREFERRED EMBODIMENTS

Figures 1, 2, 3:
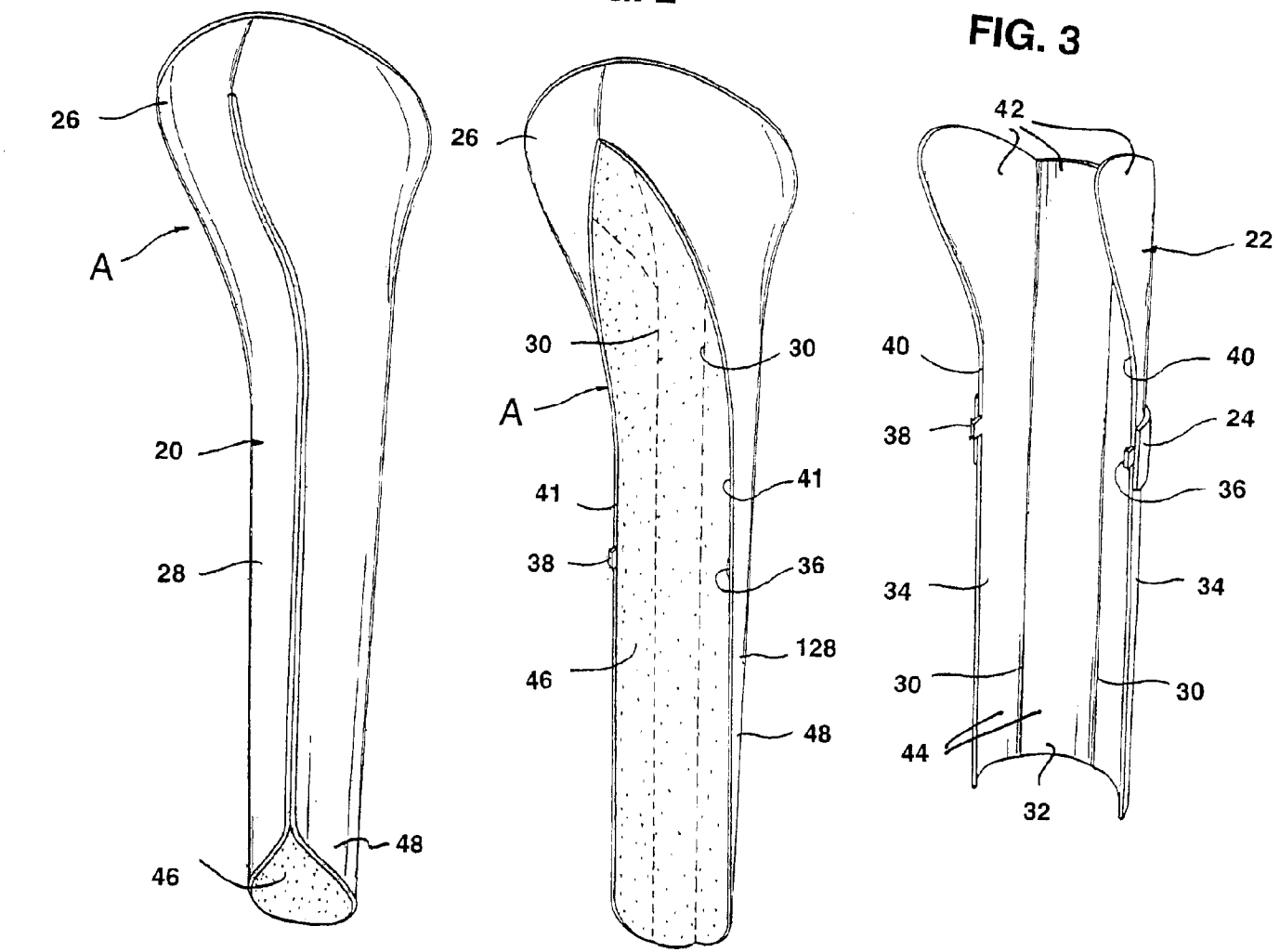
FIG. 1 is a perspective view showing a protective cover for a golf club according to one embodiment of this invention, in its closed position.
FIG. 2 is a perspective view of the protective cover for the golf club of FIG. 1, in its open position.
FIG. 3 is a perspective view of an internal frame for the cover of FIGS. 1 and 2, which is carried within the cover to give it form and shape and to control its function.
Figure 4:
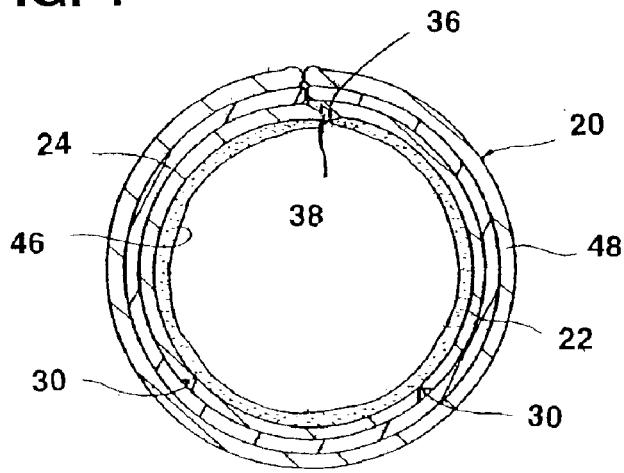
FIG. 4 is a vertical sectional view through the shaft portion of the cover of FIGS. 1–3, showing the cover with its fastening means locked.

As shown in FIGS. 1–7, a protective cover A for a golf club according to the present invention is comprised of a cover body 20 and an internal frame 22. An elastic opening means 24 is also conveniently provided, but may be an optional feature. The cover body 20 is made of a fabric, and includes a head portion 26 for covering and protecting a head H of a golf club C (FIG. 7) and a shank portion 28 extending downwardly for enclosing a portion of a shaft S of the club.

The internal frame 22 is covered by the cover body 20 except, if desired, at its free edges 40, 40. The frame 22 is formed with living hinges 30, 30 extending longitudinally along two sides of a central portion 32. Wing portions 34, 34 of the frame are swung about the hinges 30, 30 for opening and closing the cover. Fastening means 36, 38 are formed at the ends of the elastic means 24, at side edges 40, 40 of the frame 22, as shown in FIGS. 3 to 6. The fastening means comprise a locking hook 36 at one side edge 40 of the frame 24 and a locking projection 38 at the other side edge 40 thereof. The frame 22 has a head portion 42 and an opposite, lower, shank portion 44.

The elastic opening means 24 is attached to the outer surface of the frame 22. It is arranged or formed to bias the wings 34, 34 of the frame 22 by its resilience toward the open position. It may be formed of resilient plastic or metal as may be most convenient, durable, reliable, and otherwise suited to the task, or be a simple rubber or other elastic band or cord.

The cover body 20 for enclosing the golf club C is made of any suitable fabric, woven or felted, etc., and synthetic or natural, etc., in either or both of the head portion 26 and the shank portion 28. In the present embodiment, the cover body 20 consists of an inner layer 46 in contact with the golf club C and an outer layer 46 exposed on the outside. The layers are conveniently adhered permanently on their faces to the frame 22.

According to this first embodiment of the invention, the lower or shank portion 44 of the frame 22 is of the same length and circumference as the shank portion 28 of the cover body 20. However, the upper, head portion 42 of the frame 22 is shorter than the head portion 26 of the cover body 20 in order that the cover A be adaptable to cover any of most all types of golf clubs regardless of the size of the head of any particular club. That is, in accordance with the invention, the upper portion 44 of the frame 22 extends only to a part of the length of the head portion 26 of the cover 20, generally less than half that of the cover head portion 26. With this construction, a single injection-molded frame 22 can be used with a great variety of cloth covers 20, each cover—but not the frame—being adapted to each particular golf club, whether it is a wood or an iron and for each club number and for each manufacturer or line of clubs. Thus, one expensive injection mold makes a single frame of a size that can be used for a multitude of covers, interchangeably.

Figure 5:
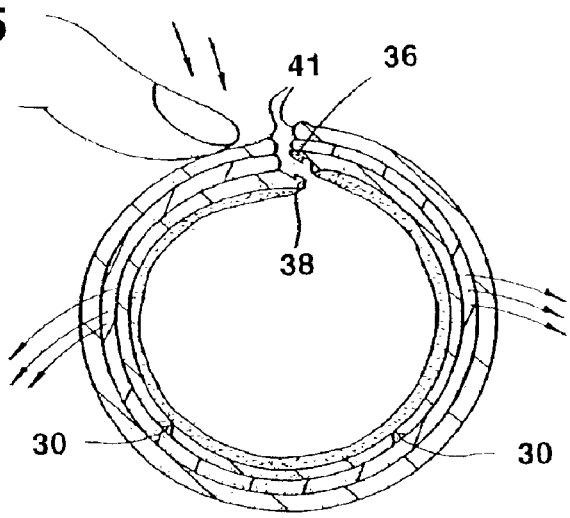
FIG. 5 is a vertical sectional view similar to FIG. 4, showing the cover for a golf club with its fastening means being released by finger pressure from a user.
Figure 6:
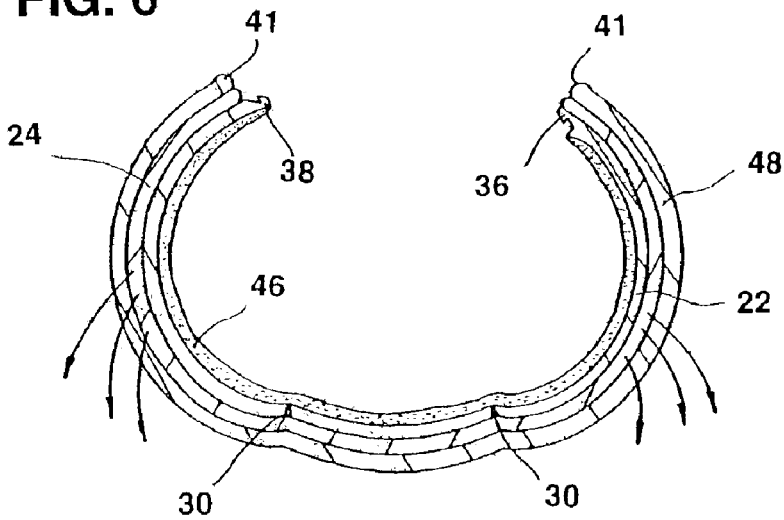
FIG. 6 is a vertical sectional view similar to FIGS. 4 and 5, showing the cover for a golf club when nearly completely opened.

The fastening means 36, 38 formed on or attached to the side edges 40, 40 of the frame 22 are made of flexible, resilient material so as to be released by an inward pressing on the one fastening means 38, as depicted in FIG. 5. Preferably, the fastening means 36, 38 are made of synthetic resin having superior elasticity. In this embodiment, the fastening means consist of a locking hook 36 at one side edge 40 of the frame 22 and a locking projection 38 at the other side edge 40 thereof. Instead of these devices, magnetic means fixed in cooperating, contacting relationship at exposed portions of both side edges 40, 40 of the frame 22 may be used.

In this first embodiment, the frame 22 includes two living hinges 30, 30 extending longitudinally of the frame 22 and spaced apart by center portion 32, so that the hinges do not form a central hump upon opening of the protective cover A. This is in contrast to known protective covers having just one hinge. Since the hinges 30, 30 are not raised and only the wings 34, 34 outwardly of the hinges 30, 30 are swung, the golf club C is easily received within the protective cover A atop the center portion 32.

Figure 8:
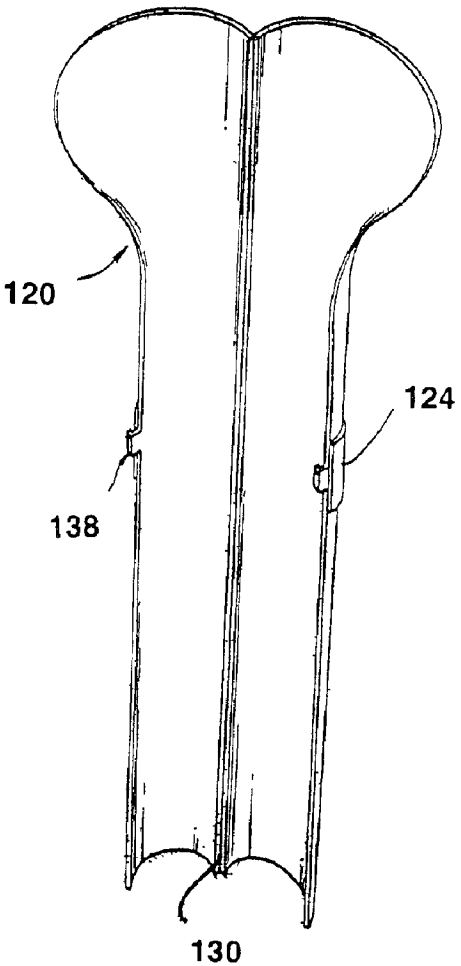
FIG. 8 is a perspective view of a second, modified protective cover, somewhat similar to FIGS. 1–7 of the present invention.
Figure 7:
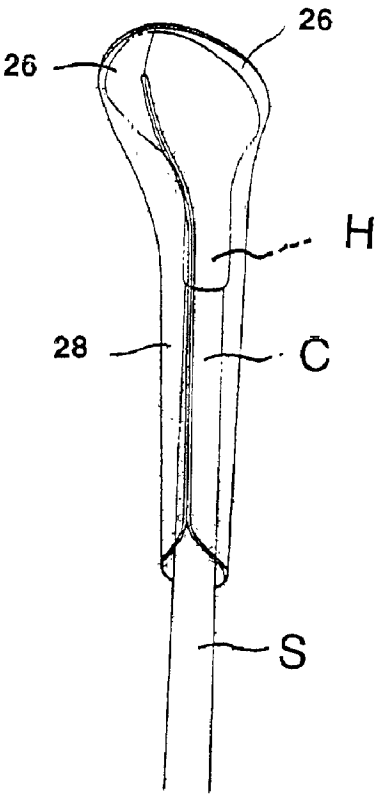
FIG. 7 is a perspective view showing a head and upper portion of a shaft of a golf club within the protective cover of FIGS. 1–6.
Figure 16:
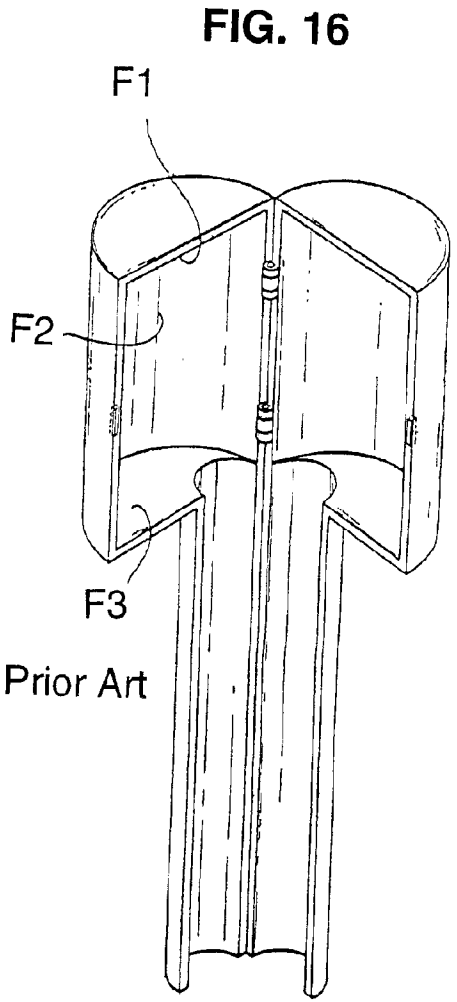
FIG. 16 is a perspective view of a further known protective cover for a golf club.
Figure 15:
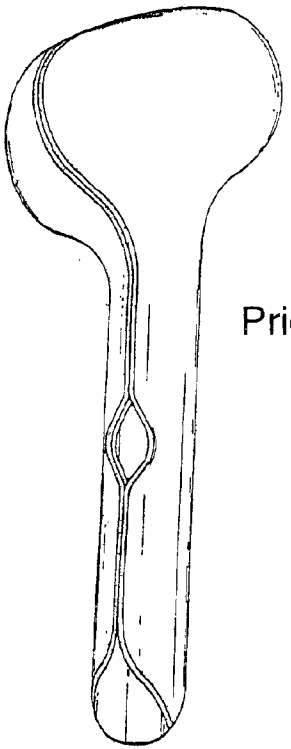
FIG. 15 is a perspective view of another known protective cover for a golf club.
Figure 14:
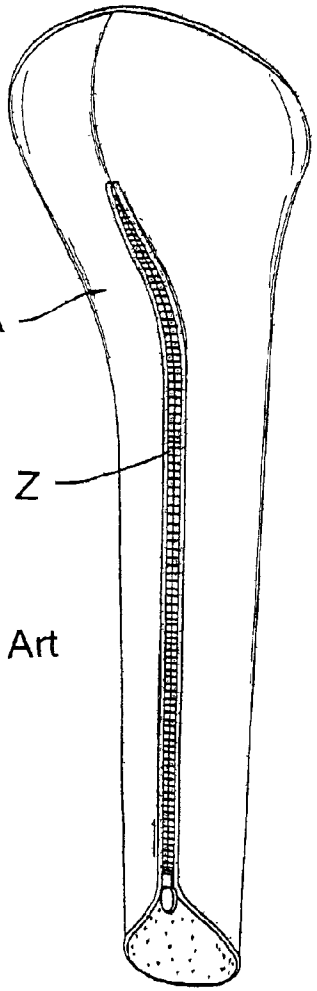
FIG. 14 is a perspective view of one conventional protective cover for a golf club.

A cover 120 with internal frame can have just one living hinge 130, as shown in FIG. 8, in a second, modified embodiment of the invention. Other hinge devices besides the living hinges shown may be used as may be suitable, such as pin and socket types, as are well known in the mechanical arts.

In the first and second embodiments, a single elastic means 24 or 124 for biasing the wings 34, 34 of the semi-cylindrical frame 22 in the direction of opening is attached to the outer surface of the frame 22 at the wings 34, 34. Alternatively, two or more elastic means 24 or 124 can be attached at two or more positions on the outer or inner surface of the frame 22, across one or more of the hinges 30 or 130, so as to urge the wings 34, 34 of the protective cover smoothly to open.

In the embodiments shown, the frame 22 has a semicircular cross-section. The frame 22 may alternatively have an oval cross-section or a polygonal cross-section, such as a square or a hexagonal section.

The frame 22 is disposed between the inner layer 46 and the outer layer 48 of the cover body 20 and is principally enclosed within the cover body 20, with only the fastening means attached to the wings being exposed outside the cover fabric 20.

As described above, in the protective cover A for the golf club C, the wings 34, 34 of the frame 22 are optionally biased to the open position by the force of the elastic means 24. Thus the frame 22 with such elastic means tends to remain open, and in that position the golf club C can be placed into the protective cover A. To accomplish this, the golf club C is held by one hand of a user and the protective cover A is held by the other hand. After the head H and the upper portion of the shaft S of the golf club C are received by the protective cover A, the user's other hand grips and closes together both side edges 41, 41 of the protective cover A, swinging them about the hinge 130 or hinges 30, 30 into close contact with each other. The hook and protrusion 36, 38 or the like lock together in a snap-fitting manner, easily locking the frame 22 closed with a single hand, thus being very convenient to use.

For taking the protective cover A off the head H of the golf club C, the fastening means 38 of the frame 22 is pressed by the user's thumb. Then, the locking projection 38 formed at one side edge 40 of the frame 22 moves downwardly or inwardly of the shank until it is disengaged from the locking hook 36 at the other side edge 40 of the frame 22. Since the wings 34, 34 positioned on both sides of the frame 22 may be biased by the elastic means 24 in the directions shown by the arrows in FIG. 5, the wings 34, 34 are swung about the hinges 30, 30 so as to open outwardly. If no elastic means 24 is used, then the wings are opened manually or by lifting the club shaft out of the cover. Thus the protective cover A easily is taken off of the head H of the golf club C.

FIGS. 9 to 11 illustrate a third embodiment of a protective cover, at B, according to this invention. In the first and second embodiments of this invention, above, the cover A has a locking hook 36 at one side edge 41 of the protective cover and a locking projection 38 at the other side edge 41 thereof, thus allowing the protective cover A easily to be opened or closed. However, it may be difficult to form or install the locking projection 38 and the locking hook 36 on the side edges 40, 40 of the frame 22, so the manufacturing cost of the mold for the frame 22 or 122 may be undesirably increased, thus resulting in increased manufacturing cost for such a cover. This third embodiment provides a protective cover with a simpler structure for the internal frame and locking means than the first and second embodiments, thus providing a lesser manufacturing cost and likely being more convenient to use.

The protective cover B of the third embodiment of the invention includes a cover body 220 and a frame 222, and optionally an elastic means 224. The cover body 220 is fabric, with a head portion 226 for covering and protecting the head H of the golf club C, and a shank portion 228 extending downwardly from the head portion 226 and enclosing the shaft S of the golf club C. The cover body 220, as in FIGS. 12 and 13, covers the internal frame 222. The frame 222 is provided with two living hinges 230, 230 extending longitudinally along two sides of a central portion 232 of the frame 222. Wings 234, 234 of the frame 222 are formed to swing about the two hinges 230, 230 to be selectively unfolded and folded.

In accordance with this embodiment of the invention, the frame 222 has on its upper side edges 240, 240 a fastening means 250 comprising a Velcro® hook and eye fastener system. A first piece 252 of the Velcro fastener is attached along one side edge 240 of the frame 222, at and over a surface 254 of one edge 240, while a second, cooperating piece 256 of the Velcro is attached along the other side edge 240 of the frame 222, at and over a surface 258, in such a way as to detachably interlock with the piece 252. The cover body 220 does not cover this part of the frame but is attached to the wings spaced apart from the edges 240, 240. In order to increase the bonding force between the one side edge 240 and the other side edge 240 of the frame 222, the two edges to which the Velcro is attached have a V-shaped male edge 254 and a cooperating V-shaped female edge 258, respectively, for increasing the contact area of the Velcro. Other surfaces can also be used, as oval and circular sections. In this embodiment, the two pieces 252 and 256 of the Velcro are attached along the contact surfaces 254, 258, respectively. Preferably, each piece 252, 256 of the Velcro is attached to two or three positions on the associated contact edge 240, 240 at regular intervals. As such, according to this third embodiment of this invention, the two pieces 252, 256 of the Velcro are utilized as the fastening means 250, so the protective cover 220 is simple in its construction, thus the protective cover is easily manufactured. In addition, the two pieces 252, 256 of the Velcro and the edge surfaces 254, 258 firmly interlock with each other upon closing of the protective cover 220, thus preventing the protective cover from being unintentionally opened, increasing the convenience of use of the cover B.

Further, a middle of the frame 222 at its upper edges 240, 240, and corresponding portions of the cover body 220 are formed with a finger hole 260 that facilitates opening and closing the protective cover. In addition, the open, lower end of the frame 222 is beveled, thus further assisting in easily opening and closing the protective cover with the user's fingers on one hand. The optional elastic means 224, if present, is attached to the surface of the frame 222 on wings 234, 234 to bias the wings by its resilience in the opening direction.

In the protective cover B according to the third embodiment, the wings 234, 234 of the frame 222 are optionally held open by the force of the elastic means 224. Thus in a normal state the frame 222 remains open, so the golf club C can be placed into the protective cover B. In use, the golf club C is held by one hand of a user and the protective cover B is held by the other hand. The head H and the upper portion of the shaft S of the golf club C are inserted into and covered by the protective cover B. Next, by grasping the protective cover B with one hand, both side edges 240, 240 of the open cover B are brought into contact with each other, shutting the cover about the club head and shaft. Further, to take the protective cover B off the head H of the golf club C, a user inserts a thumb and finger into the hole 260 of the frame 222 and separates the sides of the hole 260. Alternatively, the user opens the inclined lower end of the frame 222 with his fingers.

As soon as the fastening means 250 is released, the protective cover B is fully opened either by the resilience of the elastic means 224, or manually, thereby allowing easy removal of the protective cover B from the head H of the golf club C.

The fastening means of the third embodiment is simple in its construction and so is easily manufactured. In addition, the first piece 252 of the Velcro firmly interlocks with the second piece 256 when closing the protective cover, thus preventing the protective cover from being inadvertently removed from a golf club. Such a fastening means ensures a high bonding strength, thus allowing the protective cover to be reliably opened and closed many times, therefore being convenient to use.

As described above, the present invention provides a protective cover for golf clubs, which includes a frame that is opened and shut with a single hand. Thus, upon releasing the lock on the protective cover, the wings of the protective cover are swung outward about the hinge or hinges under the bias of the elastic means and opened fully, so that the golf club can be easily inserted into the cover. For shutting the protective cover, the wings of the frame are swung about the hinge line or lines until the locking means are fastened, thus closing and locking the protective cover. For again opening the protective cover, the frame is pressed by a user's thumb adjacent the lock or pulled apart along the Velcro® fastener until the fastening means is released and the protective cover is opened by the resilience of the elastic means, and the protective cover is easily then taken off from the head of the golf club. As a result, the protective cover for the golf club of the present invention, in any of its three embodiments, can be opened or closed with a single hand, thereby being convenient to use and rapidly put on or taken off the head of the golf club.

Although several preferred embodiments of the present invention have been disclosed for illustrative purposes, those skilled in the art will appreciate that various modifications, additions and substitutions are possible without departing from the scope and spirit of the invention as disclosed in the accompanying claims. For example, the elastic band may be omitted from the protective cover at some cost savings with only a small lessening of the convenience of the cover in use.

What is claimed is:

1. A protective cover for fitting relatively closely over and about only a single golf club and detachably covering a head of the golf club, the cover comprising:

a fabric cover body comprising, a head portion for covering and protecting the head of the golf club, and a shank portion extending downwardly from the head portion for enclosing a portion of a shaft of the golf club;

a frame principally enclosed within the cover body, the frame having an outer surface and comprising, a pair of hinges formed in and extending parallel to one another and longitudinally of the frame, and a pair of wings each formed on an opposite side of said pair of hinges and pivotable about the hinges so as to open and close the protective cover about said single golf club head, each wing having a free edge opposite the respective hinge; and a two-part fastening means, each part formed on one of the free edges of the wings and each part engaging the other free edge of the other wing for selectively locking the wings and cover body into a closed position about said single golf club head.

2. A protective cover as defined in claim 1, further comprising an elastic means attached to the outer surface of the wings and frame for elastically biasing the wings toward the open position.

3. A protective cover as defined in claim 1, wherein said fastening means comprises a locking hook affixed to one side edge of one wing and a locking projection affixed to the other side edge of the other wing, said locking projection being selectively engageable with said locking hook.

4. A protective cover as defined in claim 1, wherein said frame has a lower portion substantially filling the shank portion of the cover body and an upper portion of a size smaller than the head portion of the cover body.

5. A protective cover as defined in claim 1, wherein said fastening means comprises a Velcro® system with two cooperating, opposing strips.

6. A protective cover as defined in claim 5, wherein the free edges of the wings as form with cooperating male and female sections.

7. A protective cover as defined in claim 6, wherein the cooperating sections are V-shaped.

8. A protective cover as defined in claim 1, wherein said frame is formed with a beveled lower end.

9. A protective cover for a golf club detachably covering a head of the golf club, the cover comprising:

a fabric cover body comprising, a head portion for covering and protecting the head of the golf club, and a shank portion extending downwardly from the head portion for enclosing a portion of a shaft of the golf club;

a frame principally enclosed within the cover body, the frame having an outer surface and comprising, a pair of hinges formed in and extending parallel to one another and longitudinally of the frame, and a pair of wings each formed on an opposite side of said pair of hinges and pivotable about the hinges so as to open and close the protective cover, each wing having a free edge opposite the respective hinge;

a two-part fastening means, each part formed on one of the free edges of the wings and each part engaging the other free edge of the other wing, for selectively locking the wings and cover body into a closed position; and an elastic means comprising an elastic cord or band attached to the outer surface of the wings and frame for elastically biasing the wings toward the open position.

10. A protective cover for a head of a golf club, the cover comprising: a fabric cover body comprising:

a head portion for covering and protecting the head of the golf club; and a shank portion extending downwardly from the head portion for enclosing a portion of a shaft of the golf club;

a frame principally enclosed within and covered by the cover body, the frame comprising:

at least one hinge extending longitudinally of the frame; and a pair of wings each formed along an opposite side of said hinge or hinges and adapted to be swung about the hinge line so as to open and close the fabric cover body thereabout, and each wing having a free edge opposite the hinge, the free edges being not covered by the cover body but contacting one another when the cover is closed; and a two-piece Velcro® fastener attached to the free edges of the wings outside the cover body such that a first piece thereof detachably locks with an opposed second piece when the wings close.

11. A protective cover as defined in claim 10, further comprising elastic means attached to the outer surface of the frame for biasing the wings of the frame toward the open position.

12. A protective cover as defined in claim 10, wherein the free edges of the wings have cooperating, inter-engaging cross-sections for aligning the edges together along their lengths and increasing the contact area of the Velcro® fastener.

* * * * *